US006009566A

United States Patent [19]

Hubbard

[11] Patent Number: 6,009,566

[45] Date of Patent: Jan. 4, 2000

[54] HEAD AND NECK SUPPORT FOR RACING

[76] Inventor: Robert P. Hubbard, 160 Kenberry Dr., East Lansing, Mich. 48823

[21] Appl. No.: 09/238,274

[22] Filed: Jan. 27, 1999

Related U.S. Application Data

[60] Provisional application No. 60/072,957, Jan. 29, 1998.

[51] Int. Cl.[7] ..... A42B 3/00; A41D 13/00

[52] U.S. Cl. ..... 2/468; 2/421; 280/290

[58] Field of Search ..... 2/410, 411, 421, 2/422, 425, 455, 459, 461, 468; 280/290; 244/122 AG

[56] References Cited

U.S. PATENT DOCUMENTS

| | | | |
|---|---|---|---|
| 3,514,784 | 6/1970 | McDavid | 2/468 |
| 4,638,510 | 1/1987 | Hubbard . | |
| 4,909,459 | 3/1990 | Patterson . | |
| 4,923,147 | 5/1990 | Adams et al. . | |
| 5,267,708 | 12/1993 | Monson et al. . | |
| 5,272,770 | 12/1993 | Allen et al. | 2/468 |
| 5,715,541 | 2/1998 | Landau | 2/425 |

*Primary Examiner*—Michael A. Neas
*Attorney, Agent, or Firm*—Mary M. Moyne; Ian C. McLeod

[57] ABSTRACT

An improved head and neck support device (10) for occupants (100) of high performance vehicles, is described. The device includes a restraining yoke (12) and a collar (11). The restraining yoke has two front portions (12A and 12B) which extend down from the shoulders (102) of the occupant along the torso (104) of the occupant. The restraining yoke also includes a rear portion (12C) which extends behind the neck (106) and the shoulders of the occupant. The collar of the device extends upward from the rear portion of the restraining yoke behind the head (112) of the occupant. The collar of the device is connected by tethers (15 or 215) to the helmet (108) of the occupant. The shoulder belts (110A) of the shoulder harness (110) of the vehicle extend over the front portions and rear portion of the restraining yoke when the device is mounted on the occupant such that the device is between the shoulder belts and the occupant. The collar acts to transfer the forces from the helmet through the tethers to the collar of the restraining yoke which transfers the forces to the shoulder harness thereby reducing the forces being transmitted to the neck of the occupant.

17 Claims, 8 Drawing Sheets

HEAD AND NECK SUPPORT FOR RACING

CROSS-REFERENCE TO RELATED APPLICATIONS

This application claims the benefit of U.S. Provisional Application Ser. No. 60/072,957, filed Jan. 29, 1998.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to an improved head and neck support device for use in high performance vehicles. In particular, the present invention relates to an improved head and neck support device which is mounted on the shoulders of the occupant of the vehicle and acts to transfer force away from the neck of the occupant through the device to the shoulder harness of the vehicle.

(2) Description of the Related Art

The present invention is an improvement of Applicant's earlier head and neck support device as described in U.S. Pat. No. 4,638,510 to Hubbard. Hubbard '510 describes a head and neck support device with tethers that are attached between the driver's helmet and the collar of the head and neck support device. The head and neck support device has a yoke integral with the collar that fits around the back of the occupant's shoulders, adjacent the neck, and on the front of the occupant's chest. The yoke has an opening so that the occupant can mount the head and neck support device by placing his head through the opening. In another embodiment of Applicant's original device, the yoke is provided with a slot in the front so that the occupant can put on the device from behind by sliding the device around his neck. The original head and neck support device has been made for approximately 300 occupants of race cars and boats. Several of these occupants have crashed and have not reported that they suffered significant head or neck injuries. Many of these occupants credit their head and neck support device with reduction or elimination of head and neck injuries.

The main problem with the original head and neck support device is that the loading from the tethers must be resisted by bending of the collar and yoke of the head and neck support device. This requires a substantial collar and yoke structure which occupies space between the bottom of the occupant's helmet and torso. Although the original head and neck support device functions effectively to reduce neck loads and head accelerations, it often interferes with the bottom of the occupant's helmet.

The related art has also shown various types of head support devices for use for occupants of a vehicle. Illustrative are U.S. Pat. No. 4,909,459 to Patterson; U.S. Pat. No. 4,923,147 to Adams et al and U.S. Pat. No. 5,267,708 to Monson et al.

Patterson describes a head restraint device which connects the helmet of the occupant to the vehicle seat. The head restraint has a restraining strap which applies a single force to the head to restrain the head from horizontal forward motion and a strap assembly on the helmet to hold the head upright. The restraining strap pulls the head directly back near the middle of the head and helmet. The restraining strap only applies the force when the deceleration forces are above a predetermined level. The attachment of the strap to the helmet allows the helmet to rotate about a vertical axis approximately 180°. The restraint can also be connected to the torso of the occupant to simultaneously retract the head and the torso. The restraint must be detached for the occupant to exit the vehicle.

Adams et al describes a seat insert for a vehicle which maintains an occupant of the vehicle in a forward position during high G acceleration. The seat insert has a head support member for supporting the occupant's head during a forward, leaning posture. A head support member restraint cord is provided to restrain the movement of the head support member during an occupant's forward lean. The top and bottom of the helmet are restrained to the head support member which is behind and above the top of the helmet. The head support member tends to resist motions of the occupant's head which are downward due to accelerations. The seat insert also includes a back plate assembly connected to the head support member for supporting the spine in its natural curvature. The back plate assembly is able to pivot forward relative to the seat of the vehicle. The seat insert is able to transfer G-induced weight from the spine to the back plate assembly and ultimately to the existing seat of the vehicle. The seat insert restrains the occupant relative to the seat and must rely on restraint of the torso to be compatible with the head restraint for restraining the head relative to the torso.

Monson et al describes a head support apparatus which can be attached to a body support device. The apparatus includes a beam housing attachable to the body support device such as to be rigid in the y-z plane but to be rotatable about an x-axis. The x-axis is defined as extending through the subject's face to the back of the head. The y-axis is defined as extending laterally from ear to ear and the z-axis is defined as extending vertically from the top of the head through the subject's chin. A U-shaped rigid beam is mountable in a channel of the beam housing such that the beam is rigidly supported within the x-y plane but is able to be rotated about the x-axis. Helmet attachments are provided for supporting the helmet relative to the rigid beam within the x-z plane but allowing rotation of the helmet about the y-axis.

There remains the need for a head and neck support device which is lightweight and easily mounted on the occupant without interfering with the occupant's mobility or comfort and which transfers force away from the head and neck of the occupant to the support harness of the vehicle.

SUMMARY OF THE INVENTION

The present invention is an improved head and neck support device for use in high performance vehicles. The device includes a restraining yoke and a collar. The restraining yoke has two front portions which extend down from the shoulders of the occupant along the torso of the occupant. The restraining yoke also includes a rear portion which extends behind the neck and the shoulders of the occupant. The collar of the device extends upward from the rear portion of the restraining yoke behind the head of the occupant and is connected by tethers to the helmet of the occupant. The front portions and rear portion of the yoke are provided with load bearing surfaces. The shoulder belts of the shoulder harness of the vehicle extend over the front portions and rear portion of the restraining yoke on the load bearing surfaces when the device is mounted on the occupant such that the device is between the shoulder belts and the occupant. The collar acts to transfer the forces from the helmet through the tethers to the collar of the restraining yoke which transfers the forces through the load bearing surfaces to the shoulder belts of the shoulder harness thereby reducing the forces being transmitted to the neck of the occupant.

The substance and advantages of the present invention will become increasingly apparent by reference to the following drawings and the description.

DESCRIPTION OF THE PREFERRED EMBODIMENTS

Figure 1:
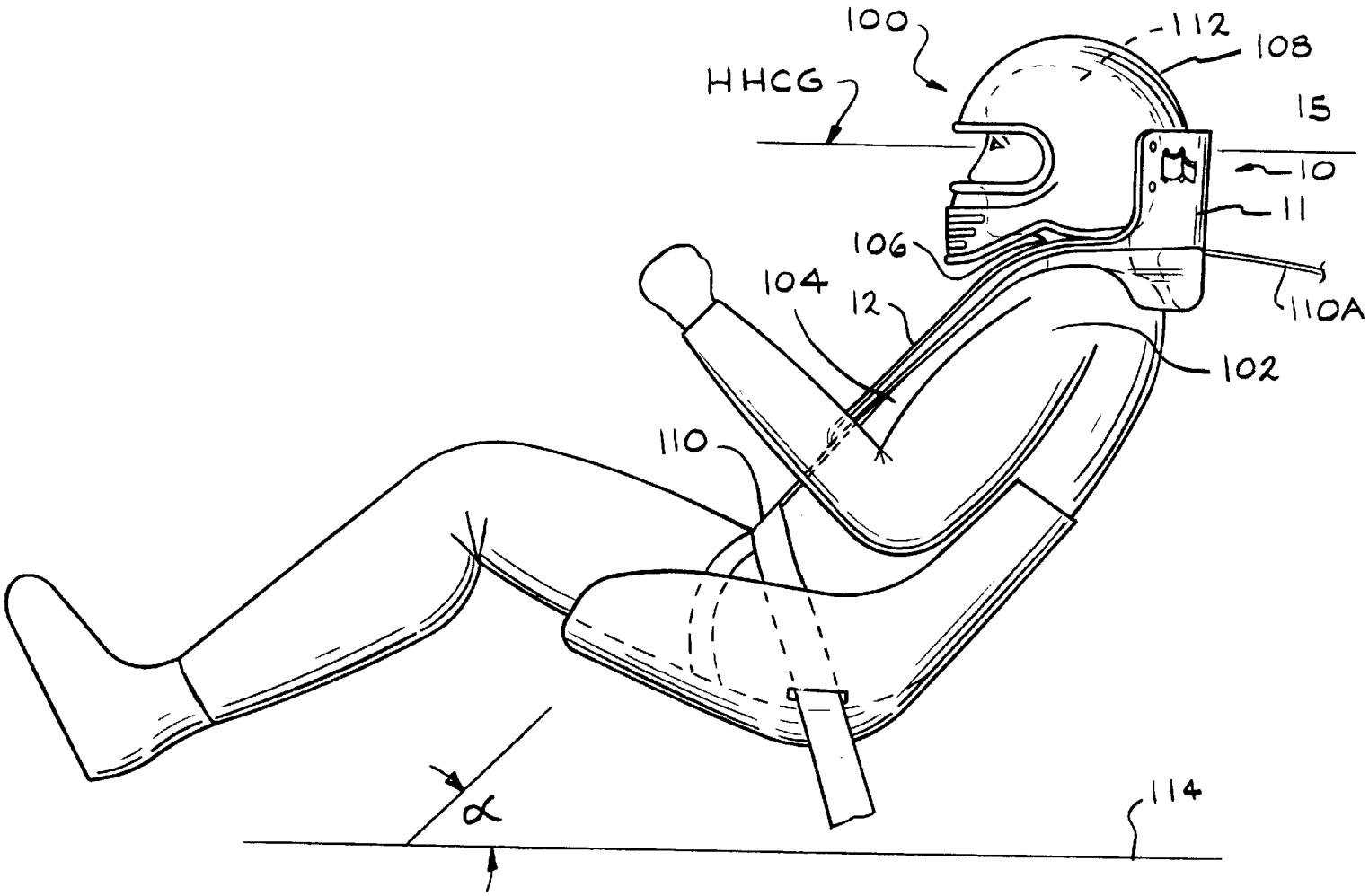
FIG. 1 is a side view of the head and neck support device 10 mounted on the shoulders 102 of an occupant 100 and connected by tethers 15 to a helmet 108.

The present invention relates to a head and neck support device for an occupant of a vehicle with a shoulder harness over shoulders of the occupant and a helmet on a head of the occupant and with a horizontal level center of gravity of the head and helmet combined at about eye level of the occupant, which comprises: a stiff restraining means including front portions and a rear portion relative to the occupant, the front portions contoured to fit a torso and shoulders of the occupant and the rear portion contoured to fit behind a neck and the shoulders of the occupant, the front and rear portions having load bearing surfaces on a side opposite the occupant wherein shoulder belts of the shoulder harness are in contact with the load bearing surfaces of the front and rear portions of the stiff restraining means when the occupant is secured in the vehicle; a stiff high collar mounted on the restraining means which extends upward from the rear portion of the restraining means to at least adjacent the horizontal level center of gravity of the head and helmet combined and adjacent the neck of the occupant which allows movement of the head to provide forward and lateral fields of view for the occupant; and tethering means attached between the collar and the helmet wherein the tethering means provides a restraint between the helmet and the collar which is in a substantially horizontal plane and wherein during normal vehicle operation or in a crash, the collar transmits forces to the restraining means from the tethering means and the load bearing surfaces of the restraining means transmit forces from the restraining means to the shoulder belts of the shoulder harness to allow the shoulder harness to provide resistance to the tethering means through the restraining means and collar thereby reducing the motions of the head relative to the torso and forces being transmitted to the neck of the occupant which may cause fatigue and injury in vehicle operation or in a crash.

Further, the present invention relates to a method for providing neck protection for an occupant of a high performance vehicle, the vehicle having a shoulder harness with shoulder belts for securing the occupant into the vehicle, which comprises: providing a helmet for a head of the occupant; providing a head and neck support device having a stiff restraining means including front portions and a rear portion relative to the occupant, the front portions contoured to fit a torso and shoulders of the occupant and the rear portion contoured to fit behind a neck and shoulders of the occupant, the front and rear portions having load bearing surfaces on a side opposite the torso of the occupant; a stiff high collar mounted on the restraining means which extends upward from the rear portion of the restraining means to at least adjacent a horizontal level center of gravity of the head and helmet combined and adjacent the neck of the occupant; and tethering means attached between the collar and the helmet; positioning the neck support device on the shoulders of the occupant such that the front portions of the restraining means are adjacent the torso of the occupant and the rear portion of the restraining means is adjacent the neck and shoulders of the occupant; positioning the helmet on the head of the occupant; attaching the tethering means between the collar of the neck support device and the helmet, wherein the tethering means provides a restraint between the helmet and the collar which is in a substantially horizontal plane; and securing the shoulder harness around the occupant such that the shoulder belts of the shoulder harness are adjacent and in contact with the load bearing surfaces of the front and rear portions of the restraining means of the neck support device, wherein during normal vehicle operation or in a crash, the collar transmits forces to the restraining means from the tethering means and the load bearing surfaces of the restraining means transmit forces from the restraining means to the shoulder belts of the shoulder harness to allow the shoulder harness to provide resistance to the tethering means through the restraining means and collar thereby reducing the motions of the head relative to the torso and forces being transmitted to the neck of the occupant which may cause fatigue and injury in vehicle operation or in a crash.

Figure 5:
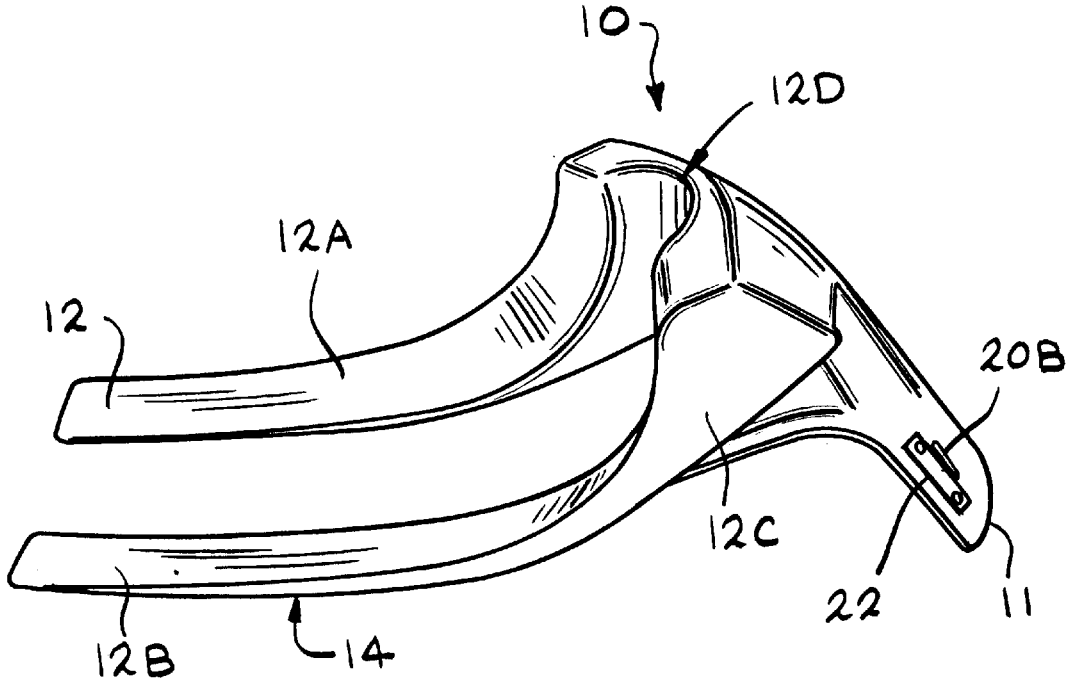
FIG. 5 is a bottom right side perspective view of the head and neck support device 10 showing the restraining yoke 12 and the collar 11.
Figure 6:
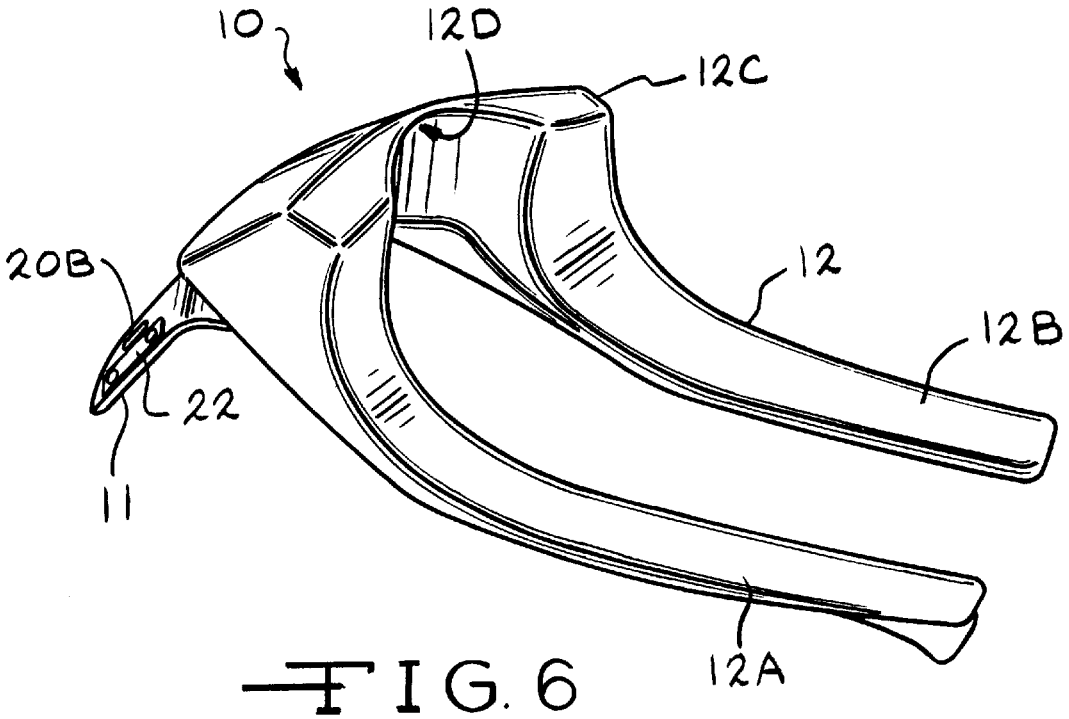
FIG. 6 is a bottom left side perspective view of the head and neck support device 10 showing the restraining yoke 12 and the collar 11.
Figure 7:
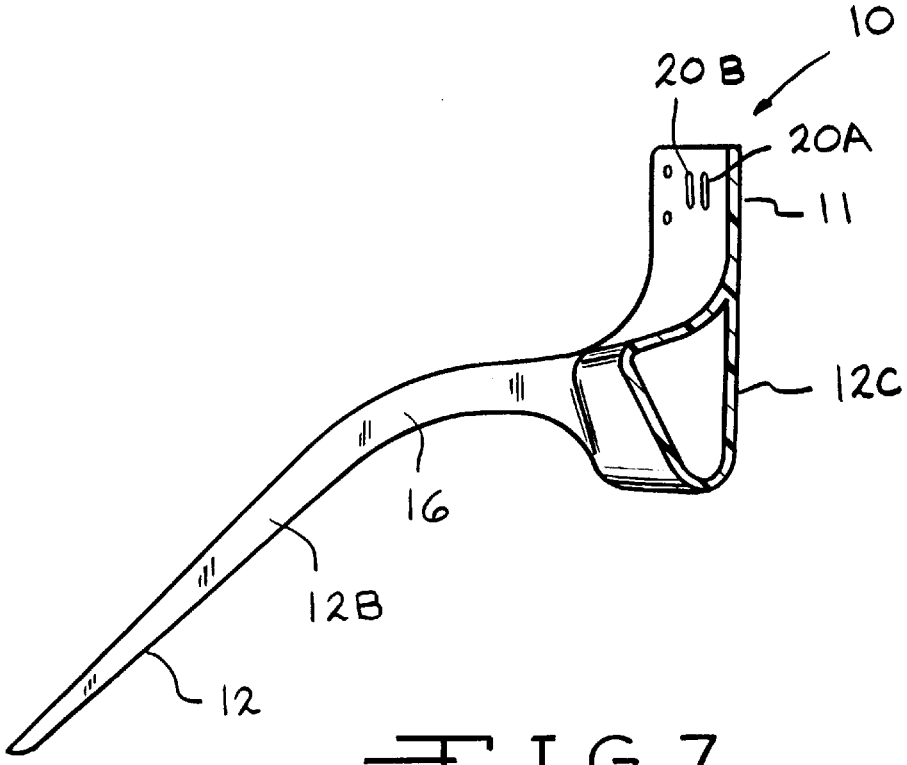
FIG. 7 is a cross-sectional view along the line 7—7 of FIG. 2 showing the rear portion 12C of the restraining yoke 12.
Figure 8:
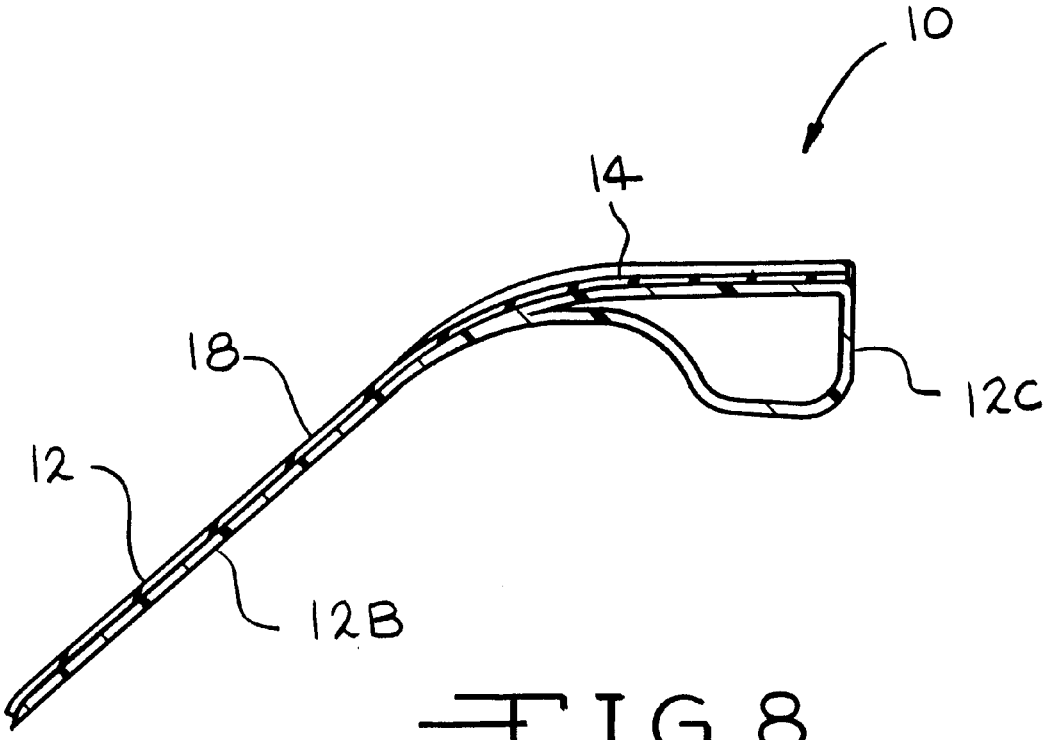
FIG. 8 is a cross-sectional view along the line 8—8 of FIG. 2 showing the front portion 12B of the restraining yoke 12 with the friction material 18 on the load bearing surface 14.
Figure 9:
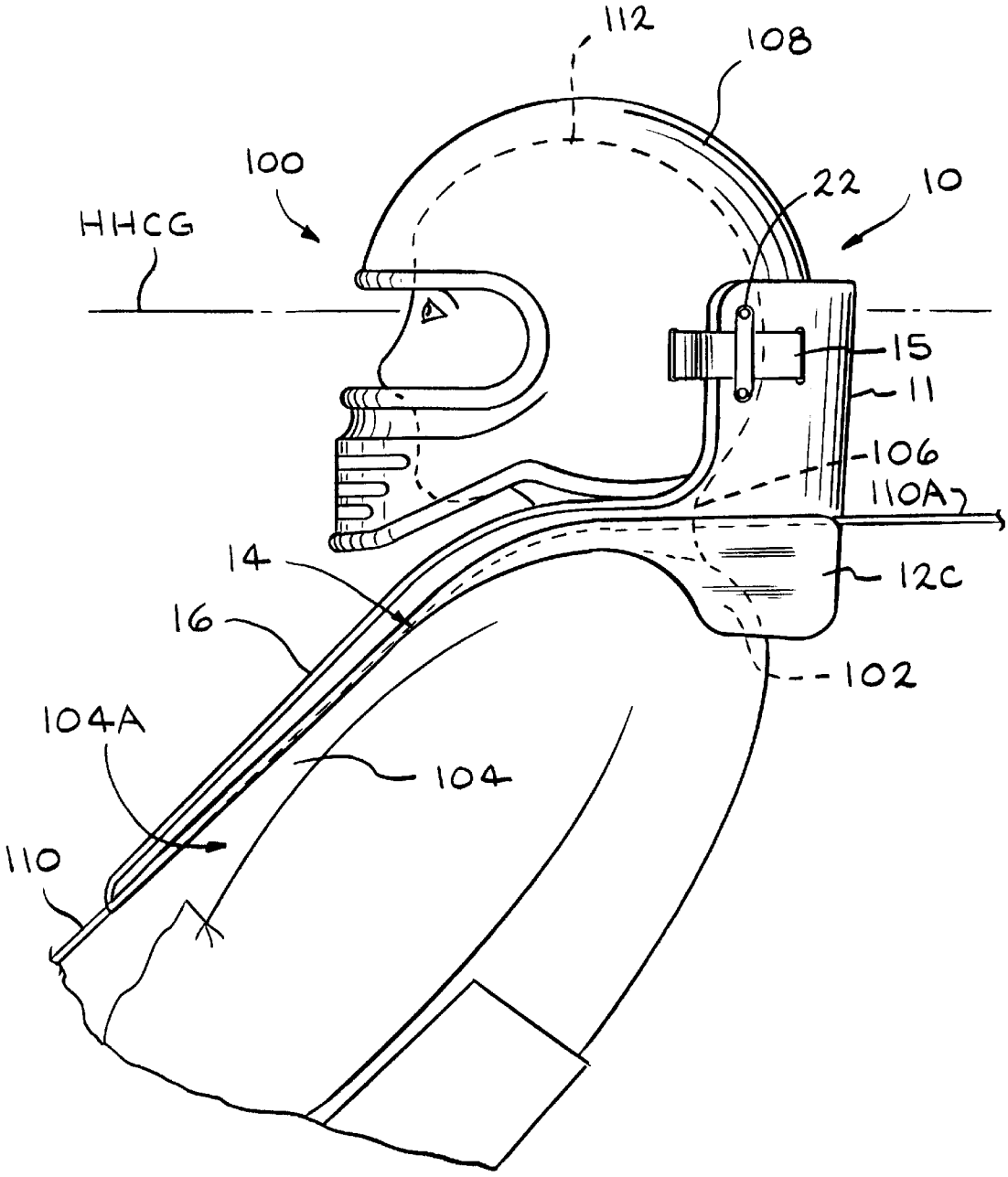
FIG. 9 is a side view of the head and neck support device 10 mounted on the occupant 100 having the positioning of the shoulder belts 110A of the shoulder harness 110 on the load bearing surfaces 14.

FIGS. 2 to 8 show the head and neck support device 10 of the present invention. FIGS. 1 and 9 show the neck support device 10 of the present invention mounted on a driver or other occupant 100 of a vehicle (not shown). The device 10 includes a restraining yoke 12 and a collar 11 formed together as an integral piece. The restraining yoke 12 is U-shaped and has a pair of front portions or legs 12A and 12B extending outward from a rear portion 12C. The front portions 12A and 12B extend forward from the rear portion 12C. The bottom surface of the restraining yoke 12 is contoured such as to conform to the shoulders 102 and a front 104A of the torso 104 or chest of the occupant 100 (FIGS. 5 and 6). The inner surface of the rear portion 12C of the restraining yoke 12 has a notch 12D between the front portions 12A and 12B to accommodate the occupant's neck 106. The rear portion 12C of the restraining yoke 12 has a thickness such that a bottom of the rear portion 12C extends down behind the shoulders 102 along the back of the occupant 100 while a top of the rear portion 12C is spaced above the shoulders 102 (FIG. 1). The rear portion 12C of the restraining yoke 12 is preferably hollow such as to reduce the weight of the device 10 (FIGS. 7 and 8).

Figure 2:
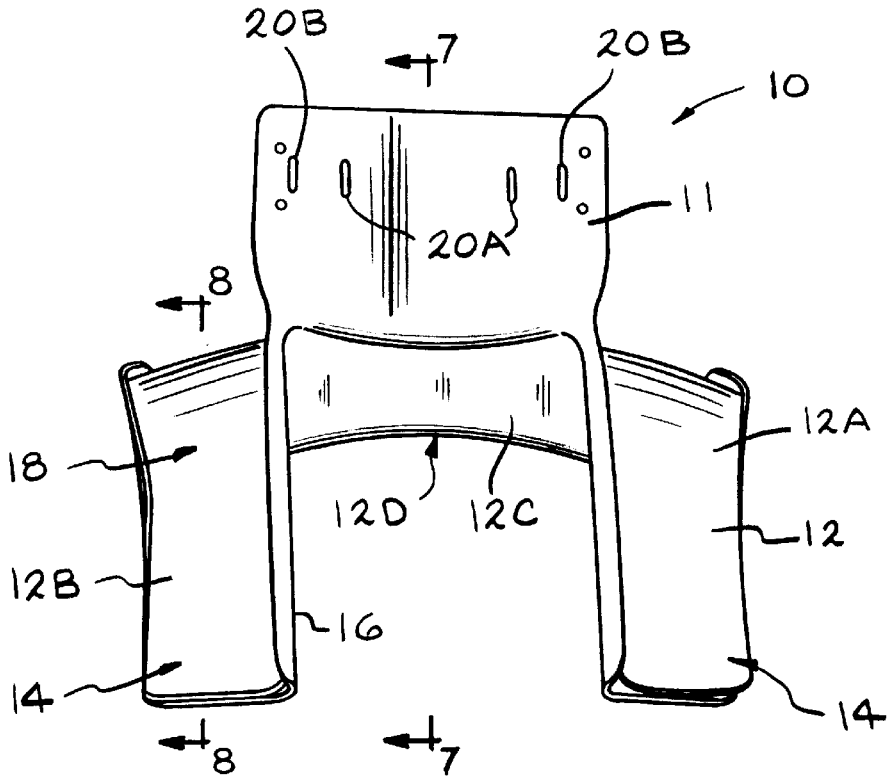
FIG. 2 is a front view of the head and neck support device 10 showing the restraining yoke 12 and the collar 11.
Figure 3:
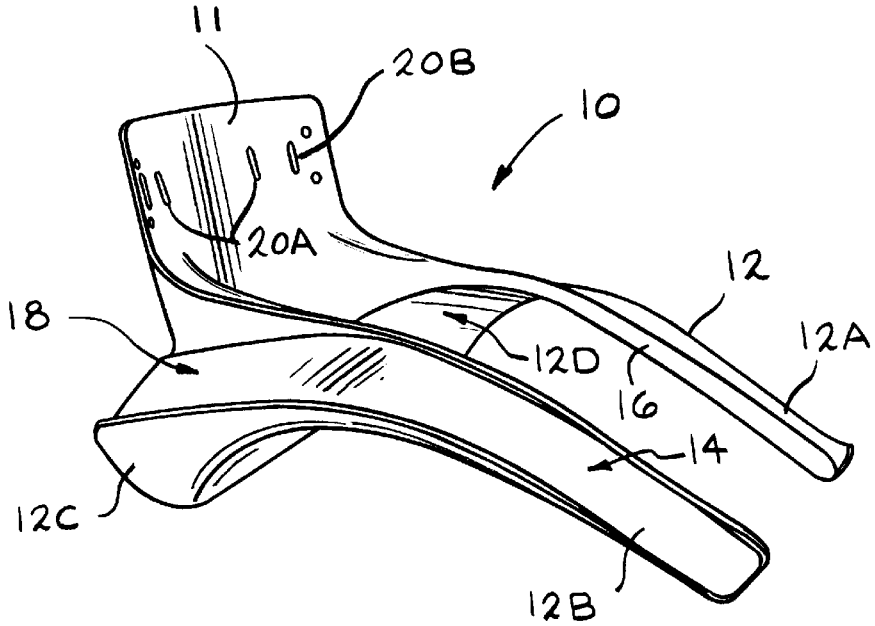
FIG. 3 is a side perspective view of the head and neck support device 10 showing the restraining yoke 12 and the collar 11.
Figure 4:
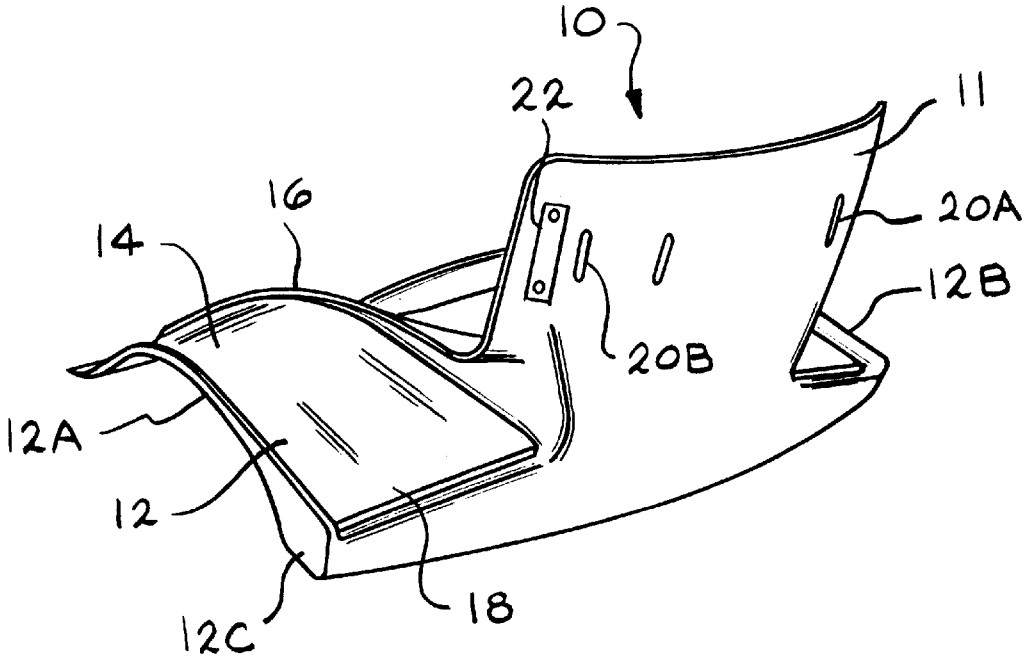
FIG. 4 is a back perspective view of the head and neck support device 10 showing the restraining yoke 12 and the collar 11.

The upper surface of the restraining yoke 12 along the front portions 12A and 12B and on the rear portion 12C adjacent the front portions 12A and 12B is provided with load bearing surfaces 14 in the form of channels on the top surface of the restraining yoke 12 (FIGS. 2 and 3). The load bearing surfaces 14 follow the shape of the upper surface of the yoke 12 along the front portions 12A and 12B and at the rear portion 12C adjacent the front portions 12A and 12B above the shoulders 102 of the occupant 100. The thickness of the rear portion 12C of the restraining yoke 12 enables the load bearing surfaces 14 adjacent the rear portion 12C of the restraining yoke 12 to be behind and essentially at a vertical level with the shoulders 102 of the occupant 100 (FIGS. 1 and 9). The inner edge of the load bearing surfaces 14 is preferably provided with a raised lip 16 such as to prevent the shoulder belts 110A of the shoulder harness 110 from slipping off the load bearing surfaces 14 toward the neck 106 of the occupant 100. The width of the load bearing surfaces 14 is preferably greater than the width of the shoulder belts 110A of the shoulder harness 110. The load bearing surfaces 14 are preferably provided with a friction material 18 which resists the shoulder belts 110A from slipping on the load bearing surfaces 14 and provides for better transference of force from the load bearing surfaces 14 to the shoulder harness 110. The belt bearing surfaces 14 are preferably flat in cross-section.

The collar 11 extends upward from the rear portion 12C of the restraining yoke 12 between the front portions 12A and 12B such that the collar 11 extends behind the head 112 of the occupant 100. The collar 11 extends upward to at least the horizontal level center of gravity of the head and helmet combined (HHCG) of the occupant 100 (FIG. 1). The collar 11 is preferably curved to follow the shape of the head 112 and helmet 108 of the occupant 100. The collar 11 is provided with a pair of inner and outer openings 20A and 20B on the left and right sides of the collar 11 adjacent the shoulders 102 of the occupant 100. The openings 20A and 20B allow for tethers or straps 15 to be connected between the collar 11 of the head and neck support device 10 and the helmet 108 positioned on the occupant 100. The openings 20A and 20B are preferably elongate and have a length and width only slightly greater than the width and thickness of the tethers 15. In the preferred embodiment, a loop 22 is provided on the left and right sides of the collar 11 adjacent the openings 20A and 20B on the outer surface of the collar 11 opposite the helmet 108. The loop 22 allows for securing the tether 15 on the collar 11. The tethers 15 extend from the openings 108A on the left and right side of the helmet 108 through the pair of openings 20A and 20B on the left and right sides of the collar 11 such that the tether 15 is wrapped around the openings 20A and 20B and secured in the openings 20A and 20B.

Figure 10:
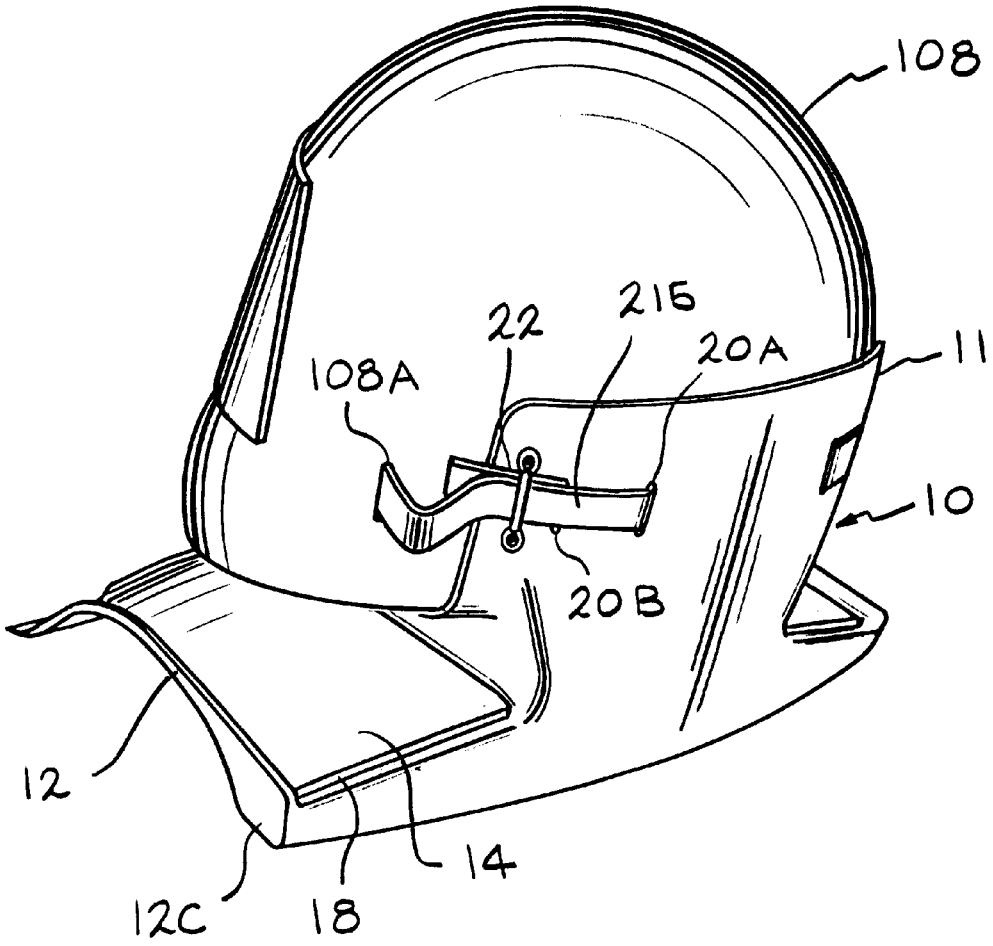
FIG. 10 is a perspective view of the head and neck support device 10 connected to the helmet 108 by an alternate tether 215.
Figure 11:
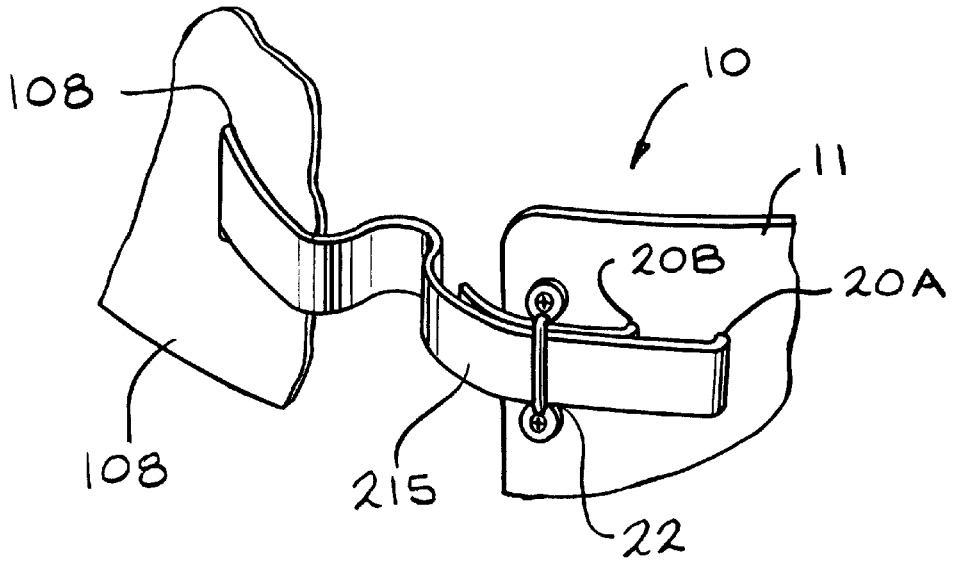
FIG. 11 is a partial view showing the alternate tether 215 connected between the head and neck support device 10 and the helmet 108.
Figure 12:
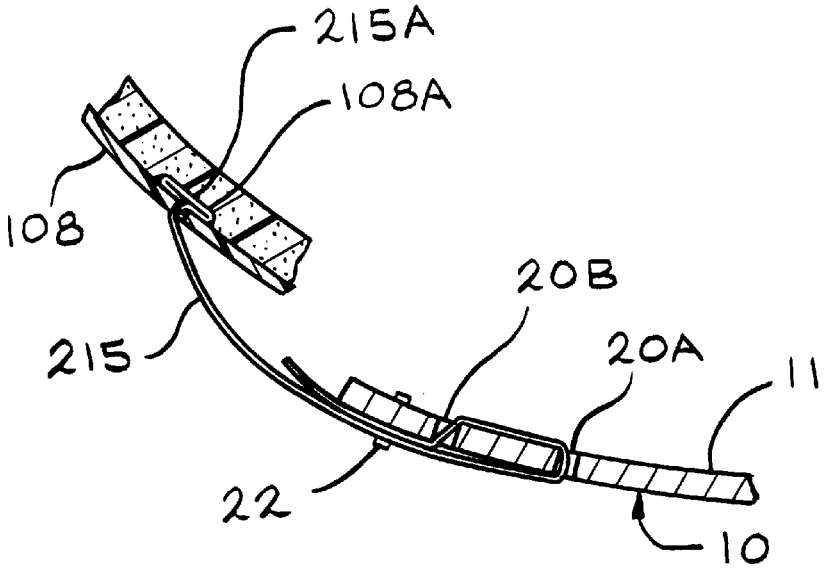
FIG. 12 is a cross-sectional view showing the alternate tether 215 connected between the helmet 108 and the head and neck support device 10.

In another embodiment as shown in FIGS. 10 to 12, the tethers 215 extend through the opening 108A in the helmet 108, along the outer surface of the helmet 108 and under the loop 22 and along the outer surface of the collar 11. The tethers 215 then extend into the inner opening 20A of the collar 11 and back along the inner surface of the collar 11 and out through the outer opening 20B of the collar 11 and under the loop 22. The first end 215A of the tether 215 is enlarged such that the first end 215A does not move through the opening 108A in the helmet 108 (FIG. 12).

Tethers 15 or 215 are provided on the left and right side of the helmet 108. The tethers 15 or 215 are preferably identical. The tethers 15 or 215 are connected in such a way as to allow side to side turning motion of the head 112 of the occupant 100. In the preferred embodiment, the tethers 15 or 215 have a fixed length. The length of the tethers 15 or 215 is such as to allow some mobility of the head 112 while preventing fatigue and potentially injurious head motions. The length of the tethers 15 or 215 preferably allows the occupant 100 to have the ability to rotate his head 112 to increase his sight area. The occupant 100 is preferably able to move his head 112 such as to have forward and lateral fields of view. The tethers 15 or 215 preferably restrict turning motion of the head 112 to about 45° on either side of center. The tethers 15 or 215 are securely but somewhat flexibly secured to the collar 11. The tethers 15 or 215 are preferably constructed of a relatively inextensible, fibrous strap material. The tethers 15 or 215 are connected between the collar 11 and the helmet 108 so that the tethers 15 or 215 are essentially in a horizontal plane at or adjacent the horizontal level of the center of gravity of the head and helmet combined (HHCG). The restraining yoke 12 and collar 11 are preferably constructed of a lightweight, durable, stiff and inflexible material such as a carbon fiber composite or a high impact resistant plastic material.

In Use

The device 10 of the present invention is mounted on the occupant 100 such that the front portions 12A and 12B of the restraining yoke 12 extend down along the chest or front 104A of the torso 104 of the occupant 100, the rear portion 12C of the restraining yoke 12 extends behind the neck 106 and shoulders 102 of the occupant 100 and the collar 11 extends upward essentially vertically behind the head 112 of the occupant 100. In the preferred embodiment, the collar 11 is spaced apart from the helmet 108 of the occupant 100. The device 10 is mounted such that the neck 106 of the occupant 100 is adjacent the notch 12D of the rear portion 12C of the restraining yoke 12. In the preferred embodiment, the front portions 12A and 12B of the restraining yoke 12 adjacent the front 104A of the torso 104 of the occupant 100 are positioned such that an angle $\alpha$ with the horizontal as defined by the horizontal axis 114 of the vehicle is approximately 30° to 50° when the device 10 is securely held in place on the occupant 100 and the occupant 100 is sitting in the vehicle (FIG. 1).

The device 10 is securely held in place by the shoulder belts 110A of the shoulder harness 110 when the occupant 100 is securely belted into the vehicle. The device 10 is only secured to the occupant 100 of the vehicle by the shoulder belts 110A. This allows the occupant 100 to exit the vehicle without having to remove the device 10. The shoulder belts 110A of the shoulder harness 110 extend along the load bearing surfaces 14 of the restraining yoke 12 such that the restraining yoke 12 is between the shoulder belts 110A and the occupant 100 and the load bearing surfaces 14 are above and behind the occupant's shoulders 102 and between the occupant's shoulders 102 and the seat back (not shown) (FIGS. 1 and 9). The load bearing surfaces 14 of the restraining yoke 12 at the rear portion 12C are positioned such that the shoulder belts 110A of the shoulder harness 110 adjacent the rear portion 12C are substantially parallel with the horizontal level of the top of the shoulders 102 of the occupant 100. The shoulder belts 110A of the shoulder harness 110 hold the restraining yoke 12 securely in contact with the front 104A of the torso 104 and the shoulders 102 of the occupant 100 during both normal vehicle operation and during a crash. The collar 11 of the device 10 is connected by the tethers 15 or 215 to the helmet 108 on the head 112 of the occupant 100. The connection of the tethers 15 or 215 to the helmet 108 tends to pull the entire device 10 forward and the rear portion 12C and collar 11 of the device 10 upward. In addition, since the forces exerted by the tethers 15 or 215 are near the top of the head and neck support device 10 and above the shoulder harness 110 which is holding the head and neck support device 10 to the torso 104 of the occupant 100, the rear portion 12C of the head and neck support device 10 tends to rotate upward and forward which is resisted by downward and rearward forces from the shoulder belts 110A on the load bearing surfaces 14 at the rear portion 12C of the yoke 12. During a crash, the tethers 15 or 215 carry tension forces from the helmet 108 to the collar 11 of the head and neck support device 10.

In rearward vehicle acceleration or frontal crash (such as in applying the brakes or striking something with the front of the vehicle) with forward head motion relative to the torso 104, the restraining yoke 12 will tend to move forward relative to the vehicle and rotate with the top of the collar 11 moving forward relative to the bottom due to the head/helmet restraining forces. The tendency for the restraining yoke 12 to move forward will be restrained by the shoulder belts 110A in much the same way as normally occurs without the device 10 present. The tendency for the top of the device 10 to rotate forward such that the rear of the device 10 moves up will be restrained by the shoulder belts 110A acting downward and rearward on the load bearing surfaces 14 of the restraining yoke 12 adjacent the top of and to the rear of the shoulders 102. This constraint of rotation will also reduce the tendency of the front, lower part of the restraining yoke 12 to load the lower part of the rib cage. The body of the occupant 100 also tends to move forward relative to the vehicle. The torso 104 of the occupant 100 is restrained by rearward force from the shoulder harness 110 and the restraining yoke 12. The shoulder harness 110 includes shoulder belts 110A over his shoulders 102, around his lap and between his legs. The head and neck support device 10 is held in place on the torso 104 of the occupant 100 by the shoulder harness 110. The head 112 tends to continue moving forward but is restrained to move with the torso 104 as a result of the forces applied through the tethers 15 or 215. Thus, the vehicle is accelerated rearward, the head 112, torso 104 and restraining yoke 12 move forward relative to the vehicle, the torso 104 and restraining yoke 12 are restrained by the shoulder harnesses 110 and the head 112 and helmet 108 are restrained to move with the torso 104 by the device 10. The forces to restrain the head 112 and helmet 108 will be predominately carried through the device 10 to the shoulder belts 110A. The tether forces restraining the head 112 reduce the loading of the neck 106. Thus, these tether forces reduce the fatiguing demands on the neck 106 and the potential for injury from the loads that would be present without the device 10. The tethers 15 or 215 also protect the occupant 100 from extreme head and neck motion relative to the torso 104. The loads from the tethers 15 or 215 are transmitted through the collar 11 and restraining yoke 12 to the torso 104 and shoulder belts 110A of the shoulder harness 110. The friction material 18 attached to the load bearing surfaces 14 increases the frictional forces acting rearward on the load bearing surfaces 14 from the shoulder belts 110A. In this way, the load bearing surfaces 14 effectively restrain the head and neck support device 10 to carry the tether forces which restrain the head 112 of the occupant 100 to move with the torso 104.

In a frontal crash, the acceleration forces and the restraint forces on the occupant 100 are primarily horizontal. The horizontal tethers 15 or 215 restrain the motions of the occupant's head 112 such that the occupant's head 112 moves with the occupant's torso 104 which reduces the forces applied to the occupant's neck 106 that may cause injuries to the head 112 and neck 106. The tethers 15 or 215 also reduce head motions and accelerations that are due to head rotations in side view. The shoulder belts 110A apply downward and rearward loads on the load bearing surfaces 14, adjacent to and behind the shoulders 102 of the occupant 100 to counteract the tether forces acting between the collar 11 of the head and neck support device 10 and the helmet 108 of the occupant 100. The loads from the shoulder belts 110A on the load bearing surfaces 14 act through the device 10 and the tethers 15 or 215 to resist the forward motions of the head 112 of the occupant 100 relative to the torso 104 of the occupant 100. Because the head and neck support device 10 is between the occupant's torso 104 and the shoulder harness 110, the forces that restrain the helmeted head 112 are transmitted through the head and neck support device 10 to the occupant's torso 104 and the shoulder harness 110.

In a rear crash with forward acceleration, the occupant 100 tends to move rearward and upward because of the angle of the seat back. The structure that supports the head 112 moves rearward with the front 104A of the torso 104. The friction with the shoulder belts 110A of the shoulder harness 110 slows the occupant 100 as the torso 104 of the occupant 100 moves forward relative to the shoulder harness 110. The device 10 is between the occupant's shoulders 102 and the shoulder belts 110A to increase the forces from the shoulder belts 110A and to create more downward force as the occupant 100 slides up the seat back. Thus, the head and neck support device 10 improves the restraint of the occupant's upper torso 104 in a rear crash.

In sideways acceleration (such as in striking an object with the side of the vehicle), assume, for the sake of illustration, that the vehicle is accelerated to the left as would occur in turning toward the left or striking an object with right side of the vehicle and that forces and motions are expressed relative to the vehicle. The torso 104 is restrained by the seat and harness 110. The helmet 108 and head 112 are restrained to accelerate to the left with the torso 104 by tension in the tethers 15 or 215 on the left side and by contact with the collar 11 on the right side. The tethers 15 or 215 are configured so that with sidewards motion the helmeted head 112 also moves rearward into the collar 11. In sideways acceleration, the loads on the collar 11 from the helmeted head 112 tend to rotate the top of the restraining yoke 12 away from the direction of the acceleration (top toward the right in the current example). The restraining yoke 12 tends to move downward onto the right shoulder 102 and upward off of the left shoulder 102. This tendency to rotate is resisted by the forces between the restraining yoke 12 and the right shoulder 102 and between the restraining yoke 12 and the shoulder harness 110 on the left side. The head 112, helmet 108 and device 10 also tend to move to the right. This motion is resisted by the shoulder harness 110 on the right and, to some extent, by the shoulder belt 110A on the load bearing surfaces 14 on the left side of the restraining yoke 12 and the contact between the collar 11 and the upper shoulders 102 and neck 106.

Thus, the accelerations of the head 112, helmet 108, neck 106 and torso 104, with components in forward, rearward or sideward directions, are restrained as combinations of the mechanical responses described above.

The load bearing surfaces 14 extend rearward from the top of the occupant's shoulders 102 so that, when racing, these load bearing surfaces 14 lie below the shoulder belts 110A of the shoulder harness 110. Since the shoulder belts 110A can be secured to the vehicle below the edge of the load bearing surfaces 14 at the rear portion 12C of the device 10, the load bearing surfaces 14 of the head and neck support device 10 will be loaded by the shoulder belts 110A while the occupant 100 is racing and this loading of the head and neck support device 10 is transmitted to the occupant's shoulders 102 to help hold the occupant 100 down in the seat.

The load bearing surfaces 14 provide a load path for the forces from the tethers 15 or 215 through the head and neck support device 10 to the shoulder belts 110A. This loading path through the head and neck support device 10 makes possible the removal of material from the head and neck support device 10, between the helmet 108 and the shoulder belts 110A that was needed in the original head and neck support device for bending resistance (U.S. Pat. No. 4,638,510). The head and neck support device 10 of the present invention is small and easy to handle which enables occupants 100 to wear the device 10 with very little interference between the head and neck support device 10 and the helmet 108.

It is intended that the foregoing description be only illustrative of the present invention and that the present invention be limited only by the hereinafter appended claims.

I claim:

1. A head and neck support device for an occupant of a vehicle with a shoulder harness over shoulders of the occupant and a helmet on a head of the occupant and with a horizontal level center of gravity of the head and helmet combined at about eye level of the occupant, which comprises:

(a) a stiff restraining means including front portions and a rear portion relative to the occupant, the front portions contoured to fit a torso and shoulders of the occupant and the rear portion contoured to fit behind a neck and the shoulders of the occupant, the front and rear portions having load bearing surfaces on a side opposite the occupant wherein shoulder belts of the shoulder harness are in contact with the load bearing surfaces of the front and rear portions of the stiff restraining means when the occupant is secured in the vehicle;

(b) a stiff high collar mounted on the restraining means which extends upward from the rear portion of the restraining means to at least adjacent the horizontal level center of gravity of the head and helmet combined and adjacent the neck of the occupant which allows movement of the head to provide forward and lateral fields of view for the occupant; and (c) tethering means attached between the collar and the helmet wherein the tethering means provides a restraint between the helmet and the collar which is in a substantially horizontal plane and wherein during normal vehicle operation or in a crash, the collar transmits forces to the restraining means from the tethering means and the load bearing surfaces of the restraining means transmit forces from the restraining means to the shoulder belts of the shoulder harness to allow the shoulder harness to provide resistance to the tethering means through the restraining means and collar thereby reducing the motions of the head relative to the torso and forces being transmitted to the neck of the occupant which may cause fatigue and injury in vehicle operation or in a crash.

2. The head and neck support device of claim 1 wherein the front and rear portions of the restraining means have channels which form the load bearing surfaces and accommodate the shoulder belts of the shoulder harness.

3. The head and neck support device of claim 2 wherein the channels have an inner lip which prevents the shoulder belts of the shoulder harness from moving inward toward the neck of the occupant.

4. The head and neck support device of claim 1 wherein in normal vehicle operation, the collar is spaced apart from the helmet of the occupant.

5. The head and neck support device of claim 1 wherein the restraining means and the collar are an integral piece.

6. The head and neck support device of claim 1 wherein the tethering means is attached between the collar and the helmet adjacent the horizontal level center of gravity of the head and helmet combined.

7. The head and neck support device of claim 1 wherein the tethering means is two straps connected to opposite sides of the collar adjacent each shoulder of the occupant.

8. The head and neck support device of claim 7 wherein the straps are of such a length as to allow side to side turning movement of the head of the occupant.

9. The head and neck support device of claim 7 wherein the straps extend through openings in the helmet along an outside of the helmet and an outside surface of the collar and in through a first opening in the collar and along an inside surface of the collar and back through a second opening in the collar.

10. The head and neck support device of claim 9 wherein a first end of the straps has an enlarged portion which prevents the first end of the straps from moving through the openings in the helmet.

11. The head and neck support device of claim 1 wherein the rear portion has a thickness such that a bottom of the rear portion contacts a back of the occupant adjacent the shoulders and a top of the rear portion having the load bearing surfaces is spaced above the shoulders of the occupant.

12. The head and neck support device of claim 11 wherein the rear portion of the restraining means is hollow such as to reduce the weight of the device.

13. The head and neck support device of claim 1 wherein the load bearing surface of the rear portion is positioned such that the shoulder belts of the shoulder harness on the load bearing surfaces of the rear portion are substantially parallel with the horizontal level of a top of the shoulders of the occupant.

14. The head and neck support device of claim 1 wherein an inner side of the rear portion has a notch to accommodate a neck of the occupant.

15. The head and neck support device of claim 1 wherein the load bearing surfaces are provided with a friction material which increases frictional forces between the load bearing surfaces and the shoulder belts.

16. The head and neck support device of claim 1 wherein there are two front portions which extend from the rear portion down a front of the torso of the occupant on each side of the neck.

17. A method for providing neck protection for an occupant of a vehicle, the vehicle having a shoulder harness with shoulder belts for securing the occupant into the vehicle, which comprises:

(a) providing a helmet for a head of the occupant;

(b) providing a head and neck support device having a stiff restraining means including front portions and a rear portion relative to the occupant, the front portions contoured to fit a torso and shoulders of the occupant and the rear portion contoured to fit behind a neck and shoulders of the occupant, the front and rear portions having load bearing surfaces on a side opposite the torso of the occupant; a stiff high collar mounted on the restraining means which extends upward from the rear portion of the restraining means to at least adjacent a horizontal level center of gravity of the head and helmet combined and adjacent the neck of the occupant; and tethering means attached between the collar and the helmet;

(c) positioning the neck support device on the shoulders of the occupant such that the front portions of the restraining means are adjacent the torso of the occupant and the rear portion of the restraining means is adjacent the neck and shoulders of the occupant;

(d) positioning the helmet on the head of the occupant;

(e) attaching the tethering means between the collar of the neck support device and the helmet, wherein the tethering means provides a restraint between the helmet and the collar which is in a substantially horizontal plane; and (f) securing the shoulder harness around the occupant such that the shoulder belts of the shoulder harness are adjacent and in contact with the load bearing surfaces of the front and rear portions of the restraining means of the neck support device, wherein during normal vehicle operation or in a crash, the collar transmits forces to the restraining means from the tethering means and the load bearing surfaces of the restraining means transmit forces from the restraining means to the shoulder belts of the shoulder harness to allow the shoulder harness to provide resistance to the tethering means through the restraining means and collar thereby reducing the motions of the head relative to the torso and forces being transmitted to the neck of the occupant which may cause fatigue and injury in vehicle operation or in a crash.

* * * * *